US011850843B2

(12) United States Patent
Yamagata et al.

(10) Patent No.: US 11,850,843 B2
(45) Date of Patent: Dec. 26, 2023

(54) PRINTING SYSTEM

(71) Applicant: RISO KAGAKU CORPORATION, Tokyo (JP)

(72) Inventors: Akihiro Yamagata, Ibaraki (JP); Ryo Terakado, Ibaraki (JP); Hirokazu Yabune, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 8 days.

(21) Appl. No.: 17/684,863

(22) Filed: Mar. 2, 2022

(65) Prior Publication Data

US 2022/0288952 A1 Sep. 15, 2022

(30) Foreign Application Priority Data

Mar. 11, 2021 (JP) ..... 2021-038898

(51) Int. Cl.
*B41J 11/00* (2006.01)
*B41J 3/54* (2006.01)
*B41J 13/00* (2006.01)

(52) U.S. Cl.
CPC ..... *B41J 11/0095* (2013.01); *B41J 3/543* (2013.01); *B41J 11/007* (2013.01); *B41J 13/0009* (2013.01)

(58) Field of Classification Search
CPC ..... B41J 15/005; B41J 11/0095; B41J 3/543; B41J 3/54; B41J 11/007; B41J 13/0009; B41J 11/00; B41J 29/393; B41J 13/0018; B41J 29/38; B41J 11/008; B41J 11/006; B65H 5/062; B65H 7/00; B65H 9/004; B65H 9/006; B65H 2513/10; B65H 2801/12; B65H 7/02; B65H 9/00
See application file for complete search history.

(56) References Cited

U.S. PATENT DOCUMENTS

2017/0182810 A1* 6/2017 Inoue ..... B41J 3/60

FOREIGN PATENT DOCUMENTS

JP 2017-119563 7/2017

* cited by examiner

*Primary Examiner* — Jannelle M Lebron
(74) *Attorney, Agent, or Firm* — GREENBLUM & BERNSTEIN P.L.C.

(57) ABSTRACT

A printing system, including a first printing part, a second printing part that is disposed downstream of the first printing part in the conveying direction of a medium, and a conveyance mechanism that conveys the medium The conveyance mechanism includes a passage detection sensor, a conveyor roller, and a resist roller that is disposed downstream in the conveying direction from the passage detection sensor and the conveyor roller, that is butted by the medium, and that conveys the medium slackened due to the butting. The printing system further includes a controller configured to control the conveyor roller so that the slack amount of the subsequent medium is constant based on the conveyance status of the preceding medium and the detection time of the leading edge of the subsequent medium detected by the passage detection sensor.

3 Claims, 6 Drawing Sheets

PRINTING SYSTEM

CROSS-REFERENCES

This application is based upon and claims the benefit of priority of the prior Japanese Patent Application No. 2021-038898, filed on Mar. 11, 2021, the entire contents of which are incorporated herein by reference.

FIELD

The embodiments discussed herein are related to a printing system.

BACKGROUND

A printing system is known which has two printing devices and an intermediate device that is disposed between the two printing devices and reverses the paper front to back. This printing system can improve printing productivity compared to a case where duplex printing is performed with a single printing device. In the above-described printing system, for example, a printing device is used in which the paper is corrected for skewness by butting a resist roller disposed upstream of the printing unit to form a slack, and then the resist roller is driven to convey the paper to the printing unit for printing.

In a printing system in which a plurality of printing devices are connected, conveying the paper is likely to be slowed down or sped up at the connection between the devices. A jam will occur if the paper is slowed down or sped up due to paper collision or other reasons. Therefore, to prevent paper collisions, a printing system has been disclosed in which paper collisions are prevented by controlling conveyance between a conveyor roller at a connection and a conveyor roller of a downstream printing device (see Japanese Laid-open Patent Publication No. 2017-119563).

SUMMARY

In one aspect, a printing system includes a first printing part that prints on the medium, a second printing part that is disposed downstream of the first printing part in the conveying direction of the medium and prints on the medium, and a conveyance mechanism that conveys the medium printed by the first printing part to the second printing part. The conveyance mechanism includes a passage detection sensor that detects the passage of the medium, a conveyor roller for conveying the medium, and a resist roller that is disposed downstream in the conveying direction from the passage detection sensor and the conveyor roller, that is butted by the medium, and that conveys the medium slackened due to the butting. The printing system further includes a controller configured to control the conveyor roller so that the slack amount of the subsequent medium is constant based on the conveyance status of the preceding medium and the detection time of the leading edge of the subsequent medium detected by the passage detection sensor.

The object and advantages of the present invention may be realized by the elements and their combinations described in the claims.

DESCRIPTION OF EMBODIMENTS

The above-described printing system for preventing paper collision did not consider that the paper interval during conveyance may fluctuate due to slippage of the printing paper and that the slack amount based on this may not be appropriate, resulting in a skew defect. In other words, if the amount of paper slippage at the connection varies from paper to paper, the timing at which the paper reaches the resist roller differs from paper to paper, resulting in cases where the slack amount is not appropriate. Specifically, when paper with a low printing rate is conveyed to the connection area after paper with a high printing rate, the slippage of the paper is different (the paper with the higher printing rate is more likely to slip), and the slack amount is likely to vary. Furthermore, as described below with reference to FIG. 6, the leading edge of the paper that is to butt the resist roller may slip through the resist roller and cause a skew defect without forming any slack.

In addition, in the connection area, the speed difference between the conveyor roller at the inlet and the conveyor roller downstream of the inlet and the difference in paper size or printing rate may cause conveyance back tension, and the timing of reaching the resist roller may be different for each paper. The paper conveyance delay can also be caused by other factors such as paper curling.

Figure 6:
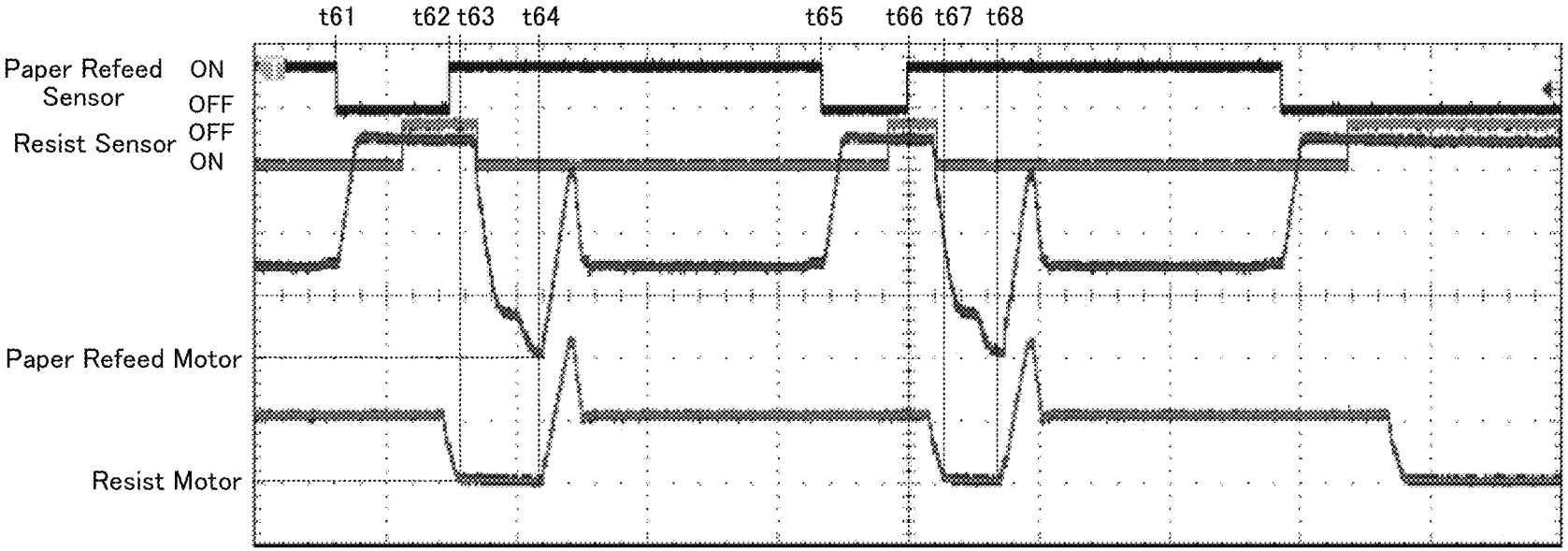
FIG. 6 illustrates the drive control of the paper refeed motor and the resist motor in the reference technique.

FIG. 6 illustrates the drive control of the paper refeed motor and the resist motor in the reference technique.

The paper refeed motor drives the paper refeed roller. The paper refeed roller conveys the paper toward the printing unit in the downstream printing device of a printing system comprising the upstream printing device and the downstream printing device.

The paper refeed sensor is disposed near the paper refeed roller on the downstream side in the conveying direction of the paper refeed roller.

The resist motor drives the resist roller. This resist roller is disposed downstream of the paper refeed sensor and upstream of the printing unit. The drive time of the resist motor (from time t64 to time t67) is always constant because a prescribed amount of control is performed by encoder conversion. The start-up time of the resist motor (times t64 and t68) is determined based on the ON timing of the paper refeed sensor (times t62 and t66).

The resist sensor is disposed near the resist roller on the upstream side of the resist roller.

For example, suppose the conveyance of a slippery paper with a high printing rate is delayed. In that case, the timing at which the leading edge of the paper is detected by the paper refeed sensor (time t62) becomes late. The inter paper interval, which is the period between the timing at which the rear edge of the preceding paper is detected by the paper refeed sensor (time t61), increases.

On the other hand, if the paper conveyed after the slippery paper is not delayed, the space between these two papers at the paper refeed sensor (time t65 to time t66) decreases. Therefore, before the end of the resist motor drive time (time t64 to time t67) for conveying the slippery paper, or specifically before the rotation of the resist roller stops, the leading edge of the next paper enters the resist roller. In this case, the paper stops with the leading edge of the paper passing through the resist roller so that no slack is formed and a skew defect occurs, as described above.

A printing system in accordance with one embodiment of the present invention will be described below with reference to the drawings.

The following embodiments exemplify devices, etc., for embodying the technical idea of the present invention, and the technical idea of the present invention does not specify the material, shape, structure, arrangement, and the like of each component part as follows. The technical idea of the present invention may be modified in various ways within the scope of the claims.

Figure 1:
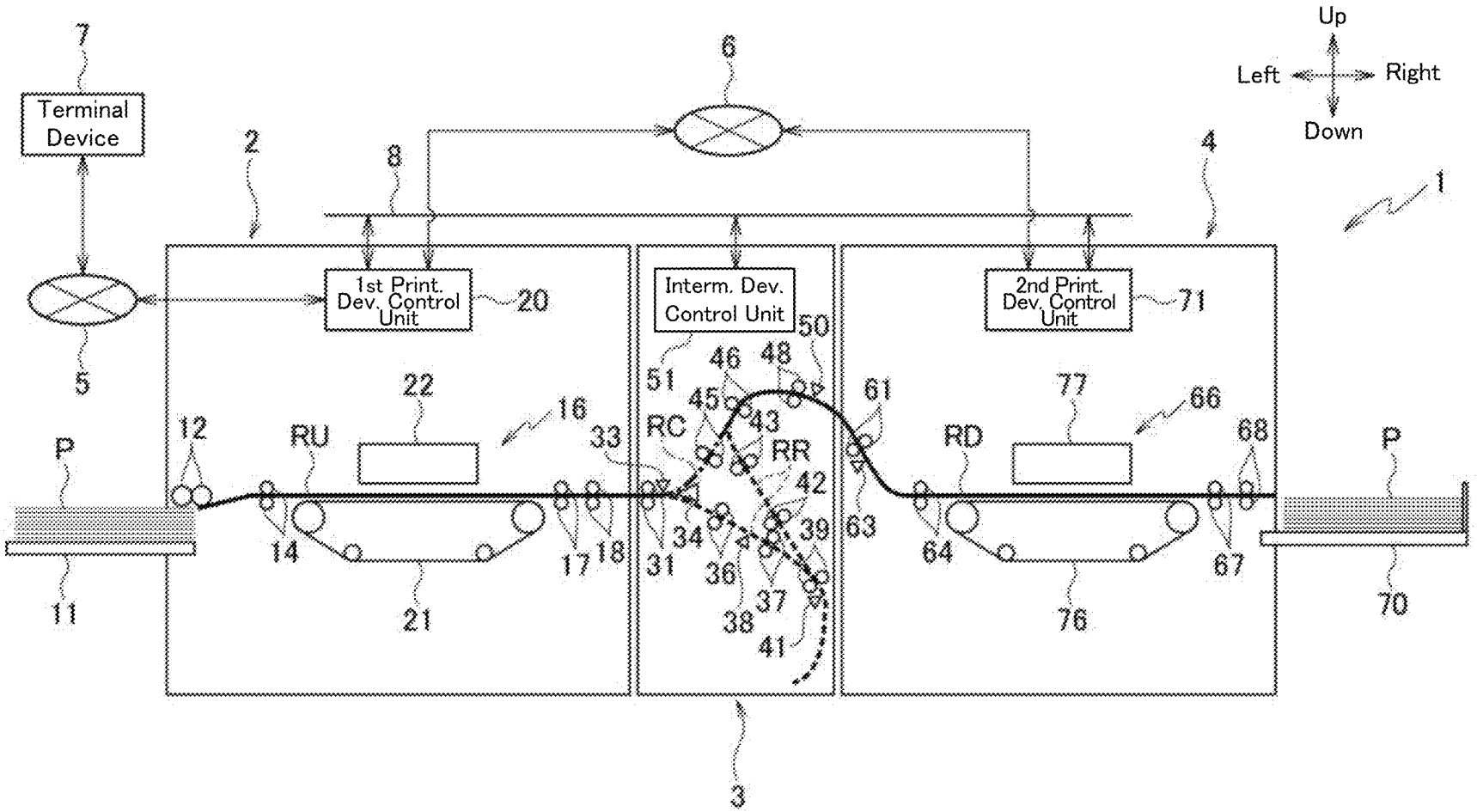
FIG. 1 is a schematic configuration diagram of a printing system in an embodiment.

FIG. 1 is a schematic configuration diagram of a printing system 1 according to an embodiment of the present invention.

Figure 2:
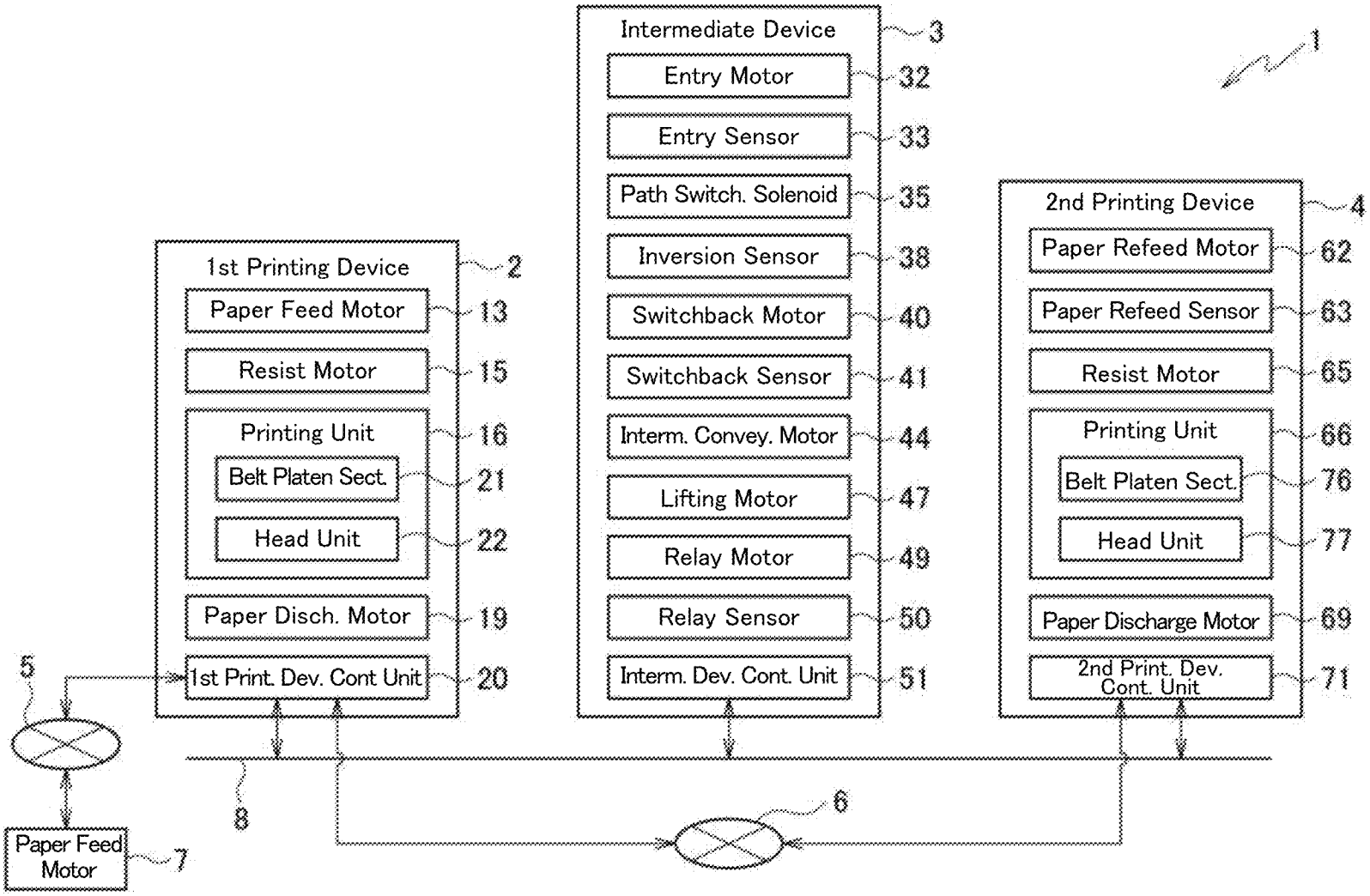
FIG. 2 is a control block diagram of a printing system in an embodiment.

FIG. 2 is a control block diagram of the printing system 1.

In the following description, the direction perpendicular to the paper surface in FIG. 1 is the front-back direction.

The up, down, left, and right sides of the paper in FIG. 1 are the up, down, left, and right directions. The path shown in bold lines in FIG. 1 is a conveyance path along which paper P, an example of a medium, is conveyed. Among the conveyance paths, the paths shown in solid lines are the upstream conveyance path RU and the downstream conveyance path RD, the path shown by dashed lines is the inversion path RR, and the path shown by one-dot chain lines is the non-inverted intermediate path RC. Upstream and downstream in the following description mean upstream and downstream in the conveying direction on the conveyance path.

As shown in FIGS. 1 and 2, printing system 1 comprises a first printing device 2, an intermediate device 3, and a second printing device 4. Since it is sufficient for the printing system of this embodiment to comprise a first printing unit (first printing part), of which the printing unit 16 is one example, a second printing unit (second printing part), of which the printing unit 66 is one example, and a conveyance mechanism that conveys the paper P (medium) printed by the first printing unit to the second printing unit, the intermediate device 3 may be omitted. The first printing device 2 and the second printing device 4 do not need to be arranged independently. Therefore, a printing device comprising, for example, a first printing unit and a second printing unit in a single housing also functions as a printing system.

The first printing device 2 prints an image on the paper P and feeds the paper P to the intermediate device 3. The first printing device 2 comprises a paper feed tray 11, a paper feed roller 12, a paper feed motor 13, a resist roller 14, a resist motor 15, a printing unit 16, paper discharge rollers 17, 18, a paper discharge motor 19, and a first printing device control unit 20. The first printing device 2 can be regarded as an external device of the second printing device 4.

The paper feed tray 11 is loaded with paper P used for printing.

The paper feed roller 12 takes out the paper P stacked on the paper feed tray 11 one by one and conveys it to the resist roller 14. The paper feed roller 12 performs an assist operation to assist the conveyance of the paper P by the resist roller 14. The paper feed roller 12 is disposed at the upstream end of the upstream conveyance path RU.

The paper feed motor 13 rotates and drives the paper feed roller 12.

The resist roller 14 conveys the paper P toward the printing unit 16 after the paper P conveyed from the paper feed roller 12 butts it, and slack is formed in the paper P.

The resist motor 15 rotates and drives the resist roller 14.

The printing unit 16 prints an image on the paper P while conveying the paper P. The printing unit 16 comprises a belt platen section 21 and a head unit 22. The printing unit 16 is an example of the first printing unit (first printing part) that prints on the paper P (medium).

The belt platen section 21 adsorbs and holds the paper P conveyed from the resist roller 14 on the belt and conveys it.

The head unit 22 prints an image by ejecting ink onto the paper P conveyed by the belt platen section 21. The head unit 22 has an inkjet head (not shown) having a plurality of nozzles arranged along the front-to-back direction and discharges ink from the nozzles of the inkjet head onto the paper P.

The paper discharge rollers 17 and 18 discharge the paper P conveyed from the belt platen section 21 to the intermediate device 3.

The paper discharge motor 19 rotates and drives the paper discharge rollers 17 and 18.

The first printing device control unit 20 controls the operation of each part of the first printing device 2. The first printing device control unit 20 has a processor (e.g., a CPU: Central Processing Unit). The first printing device control unit 20 has a memory such as a ROM (Read Only Memory), a read-only semiconductor memory in which a predetermined control program is recorded in advance. The processor has memory such as RAM (Random Access Memory), which is a semiconductor memory that is writable and readable at any time and used as a working memory area as necessary when the processor executes various control programs.

The first printing device control unit 20 can communicate with a terminal device 7 comprising a PC, or the like, via the first network 5 comprising a LAN, or the like. In addition, the first printing device control unit 20 can communicate with the second printing device control unit 71 of the second printing device 4 described below via the second network 6 comprising a LAN or the like. The first printing device control unit 20 can also communicate with the intermediate device control unit 51 of the intermediate device 3 and the second printing device control unit 71 of the second printing device 4 described below via the communication line 8.

When the first printing device 2 prints, the first printing device control unit 20 controls the paper P so that the paper is taken out from the paper feed tray 11 by the paper feed roller 12 and the paper P butts the resist roller 14. Thereafter, the first printing device control unit 20 controls the resist roller 14, drives it and assists it with the paper feed roller 12 to convey the paper P to the printing unit 16. Then, the first printing device control unit 20 controls the printing unit 16 to print an image on the paper P by the head unit 22 while the belt platen section 21 conveys the paper P.

The intermediate device 3 conveys the paper P between the first printing device 2 and the second printing device 4. The intermediate device 3 is disposed adjacent to the downstream side (right side) of the first printing device 2. The intermediate device 3 comprises an entry roller 31, an entry motor 32, an entry sensor 33, a path switching flipper 34, a path switching solenoid 35, inversion rollers 36 and 37, an inversion sensor 38, a switchback roller 39, a switchback motor 40, a switchback sensor 41, intermediate rollers 42 and 43, an intermediate conveyance motor 44, a face-up roller 45, a lifting roller 46, a lifting motor 47, a relay roller 48, a relay motor 49, a relay sensor 50, and an intermediate device control unit 51.

Here, the intermediate device 3 functions as an example of a conveyance mechanism, together with paper discharge rollers 17 and 18, and paper discharge motor 19 of the first printing device 2, the paper refeed roller 61, paper refeed motor 62, and paper refeed sensor 63, resist roller 64, and resist motor 65 of the second printing device 4 described below. This conveyance mechanism conveys the paper P (medium) printed by the printing unit 16 (first printing unit) of the first printing device 2 to the printing unit 66 (second printing unit) of the second printing device 4.

The entry roller 31 takes the paper P discharged from the first printing device 2 into the intermediate device 3. The entry roller 31 is disposed at the downstream end of the upstream conveyance path RU and at the upstream end of the conveyance path in the intermediate device 3.

The entry motor 32 rotates and drives the entry roller 31, the inversion roller 36, and the face-up roller 45.

The entry sensor 33 detects the paper P entered the intermediate device 3 from the first printing device 2. The entry sensor 33 is disposed near the downstream side of the entry roller 31.

The path switching flipper 34 switches the path of the paper P conveyed along the upstream conveyance path RU between the inversion path RR and the non-inverted intermediate path RC.

The path switching solenoid 35 drives the path switching flipper 34.

The inversion rollers 36 and 37 convey the paper P led to the inversion path RR by the path switching flipper 34 to the switchback roller 39.

The inversion sensor 38 detects the paper P conveyed by the inversion rollers 36 and 37 to the switchback roller 39. The inversion sensor 38 is disposed between the entry sensor 33 and the switchback roller 39 and between the inversion rollers 36 and 37.

The switchback roller 39 switches back the paper P conveyed by the inversion rollers 36 and 37 and conveys it to the intermediate roller 42. The switchback roller 39 is configured for forward and reverse rotation to switch back the paper P.

The switchback motor 40 drives the switchback roller 39 in forward and reverse rotation.

The switchback sensor 41 detects the paper P to be switched back by the switchback roller 39.

The intermediate rollers 42 and 43 convey the paper P switched back by the switchback roller 39 to the lifting roller 46.

The intermediate conveyance motor 44 rotates and drives the inversion roller 37 and the intermediate rollers 42 and 43.

The face-up roller 45 conveys the paper P led to the non-inverted intermediate path RC by the path switching flipper 34 to the lifting roller 46.

The lifting roller 46 conveys the paper P conveyed from the intermediate roller 43 or the face-up roller 45 to the relay roller 48. The lifting roller 46 is disposed on the downstream conveyance path RD near the downstream side of the merging point of the inversion path RR and the non-inverted intermediate path RC.

The lifting motor 47 rotates and drives the lifting roller 46.

The relay roller 48 conveys the paper P conveyed from the lifting roller 46 to the second printing device 4.

The relay motor 49 rotates and drives the relay roller 48.

The relay sensor 50 detects the paper P conveyed by the relay roller 48 to the second printing device 4. The relay sensor 50 is disposed near the downstream side of the relay roller 48, near the outlet of the paper P from the intermediate device 3.

The intermediate device control unit 51 controls the operation of each part of the intermediate device 3. The intermediate device control unit 51 has a processor (e.g., a CPU), memory such as RAM and ROM, and the like. The intermediate device control unit 51 can communicate with the first printing device control unit 20 of the first printing device 2 and the second printing device control unit 71 of the second printing device 4 described below via the communication line 8.

The second printing device 4 prints on the paper P conveyed from the intermediate device 3. The second printing device 4 is disposed adjacent to the downstream side (right side) of the intermediate device 3. The second printing device 4 is provided with a paper refeed roller 61, a paper refeed motor 62, a paper refeed sensor 63, a resist roller 64, a resist motor 65, a printing unit 66, paper discharge rollers 67 and 68, a paper discharge motor 69, a paper discharge table 70, and a second printing device control unit 71.

The paper refeed roller 61 conveys the paper P conveyed from the relay roller 48 of the intermediate device 3 to the resist roller 64. The paper refeed roller 61 performs an assist operation to assist the conveyance of the paper P by the resist roller 64. The paper refeed roller 61 is disposed at an upstream end of the downstream conveyance path RD in the second printing device 4. The paper refeed roller 61 is an example of a conveyor roller that conveys the paper P (medium). This conveyor roller should be the roller upstream of the resist roller 64, and closest to the resist roller 64, such as the paper refeed roller 61.

The paper refeed motor 62 rotates and drives the paper refeed roller 61. The paper refeed motor 62 is an example of a conveyance drive unit (conveyance drive) that drives the paper refeed roller 61 (conveyor roller).

The paper refeed sensor 63 detects the paper P conveyed from the paper refeed roller 61 to the resist roller 64. The paper refeed sensor 63 is disposed upstream of the resist roller 64 and near the downstream side of the paper refeed roller 61. The paper refeed sensor 63 is an example of a passage detection sensor that detects the passage of the paper P (medium).

The resist roller 64 is disposed downstream from the paper refeed sensor 63, and the paper refeed roller 61. The paper P conveyed from the paper refeed roller 61 butts the resist roller 64. The paper P that has slackened due to the butting is conveyed toward the printing unit 66.

The resist motor 65 rotates and drives the resist roller 64. The resist motor 65 is an example of a resist drive unit (resist drive) that drives the resist roller.

The printing unit 66 prints an image on the paper P while conveying the paper P. The printing unit 66 comprises a belt platen section 76 and a head unit 77. The printing unit 66 is disposed downstream in the conveying direction of the paper P from the printing unit 16 (first printing unit) and is an example of a second printing unit (second printing part) that prints on the paper P (medium).

The belt platen section 76 and the head unit 77 have the same configuration as the belt platen section 21 and the head unit 22 of the first printing device 2 described above, respectively.

The paper discharge rollers 67 and 68 discharge the paper P conveyed from the belt platen section 76 to the paper discharge table 70.

The paper discharge motor 69 rotates and drives the paper discharge rollers 67 and 68.

The paper discharge table 70 holds the paper P discharged by the paper discharge rollers 67 and 68.

The second printing device control unit 71 controls the operation of each part of the second printing device 4. The second printing device control unit 71 has a processor (e.g., a CPU), memory such as RAM and ROM, and the like. The second printing device control unit 71 can communicate with the first printing device control unit 20 of the first printing device 2 via the second network 6. The second printing device control unit 71 can communicate with the first printing device control unit 20 of the first printing device 2 and the intermediate device control unit 51 of the intermediate device 3 via the communication line 8.

As will be described in detail later, when printing is performed in the second printing device 4, the second printing device control unit 71 makes the paper P conveyed from the intermediate device 3 butt the resist roller 64 by the paper refeed roller 61 and stops the paper refeed roller 61. Thereafter, the second printing device control unit 71 controls to drive the resist roller 64 and assist the resist roller 64 with the paper refeed roller 61 to convey the paper P to the printing unit 66. Then, the second printing device control unit 71 controls the printing unit 66 to print an image on the paper P by the head unit 77 while the paper P is conveyed by the belt platen section 76. Here, the second printing device control unit 71 is an example of a control unit (controller) that controls the paper refeed roller 61 so that the slack amount of the subsequent paper P becomes constant based on the conveyance status of the preceding paper P and the detection time of the leading edge of the subsequent paper P detected by the paper refeed sensor 63, as described below.

Next, duplex printing operation with printing system 1 will be described.

Duplex printing operation in the printing system 1 is initiated when the first printing device control unit 20 receives a print job for duplex printing from the terminal device 7 via the first network 5.

When the first printing device control unit 20 receives the print job, it starts driving the belt platen section 21 and the paper discharge rollers 17 and 18.

When the first printing device control unit 20 receives a print job, it transmits the print job to the second printing device control unit 71 via the second network 6. The first printing device control unit 20 sends a preparation signal to the intermediate device control unit 51 to instruct the start of preparation for duplex printing via the communication line 8.

When the second printing device control unit 71 receives the print job, it starts driving the paper refeed roller 61, the belt platen section 76, and the paper discharge rollers 67 and 68.

When the intermediate device control unit 51 receives the preparation signal, it starts driving the entry roller 31, the inversion rollers 36 and 37, the switchback roller 39, the intermediate rollers 42 and 43, the lifting roller 46, and the relay roller 48. The intermediate device control unit 51 sets the path switching flipper 34 in the direction of leading the paper P from the upstream conveyance path RU to the inversion path RR.

The first printing device control unit 20 starts feeding the paper from the paper feed tray 11 to the printing unit 16 after starting to drive the belt platen section 21 and the paper discharge rollers 17 and 18. The paper P then butts the resist roller 14 and stops in a state where slack is formed. As a result, the skew of the paper P is corrected.

When a predetermined time elapses after the paper feed roller 12 stops, the first printing device control unit 20 causes the resist roller 14 to start driving. The first printing device control unit 20 starts the assist operation by the paper feed roller 12 at the same time as the resist roller 14 starts to be driven. After this, the first printing device control unit 20 controls the resist roller 14 to convey the paper P to the printing unit 16. The assist operation ends before the rear edge of the paper P has left the paper feed roller 12. This prevents the paper feed roller 12 from accidentally conveying the next paper P. By repeating such operations of the paper feed roller 12 and the resist roller 14, the paper P is sequentially conveyed to the printing unit 16.

The paper P conveyed to the printing unit 16 is printed on the surface by the head unit 22 while being conveyed by the belt platen section 21. The paper P printed in the printing unit 16 is discharged to the intermediate device 3 by the paper discharge rollers 17 and 18.

The paper P discharged to the intermediate device 3 is switched back into the intermediate device 3.

In the intermediate device 3, the paper P is received and conveyed by the entry roller 31 and is led from the upstream conveyance path RU to the inversion path RR by the path switching flipper 34. The paper P led to the inversion path RR is conveyed by the inversion rollers 36 and 37 to the switchback roller 39.

When the paper P reaches the switchback roller 39, the paper P is accepted by the switchback roller 39 and is conveyed at a preset inverted conveyance speed.

When a predetermined time has elapsed after the switchback roller 39 stops, the intermediate device control unit 51 starts the inverse drive of the switchback roller 39.

The switched back paper P is conveyed by the intermediate rollers 42 and 43, the lifting roller 46, and the relay roller 48, and is fed to the second printing device 4. The paper P is fed to the second printing device 4 in a reversed state by being switched back in the intermediate device 3.

The paper P fed from the intermediate device 3 to the second printing device 4 is received and conveyed by the paper refeed roller 61 and butts the resist roller 64. Afterward, the paper P is conveyed by the resist roller 64 to the printing unit 66. In this case, the paper refeed roller 61 performs an assisting operation to assist the conveyance of the paper P by the resist roller 64.

The operation of the paper refeed roller 61 and the resist roller 64 is controlled based on the timing at which the leading edge of the paper is detected by the paper refeed sensor 63. When the size of the paper P is larger than a predetermined size, the relay roller 48 performs a deceleration butting operation and an assist operation in synchronization with the paper refeed roller 61. Specifically, if the paper P is of a size whose rear edge has not been pulled out of the relay roller 48 (nipped by the relay roller 48) when the paper P butts the resist roller 64, the relay roller 48 operates in synchronization with the paper refeed roller 61 until the paper P is pulled out.

The operations of the relay roller 48, the paper refeed roller 61, and the resist roller 64 will now be described.

Figure 3:
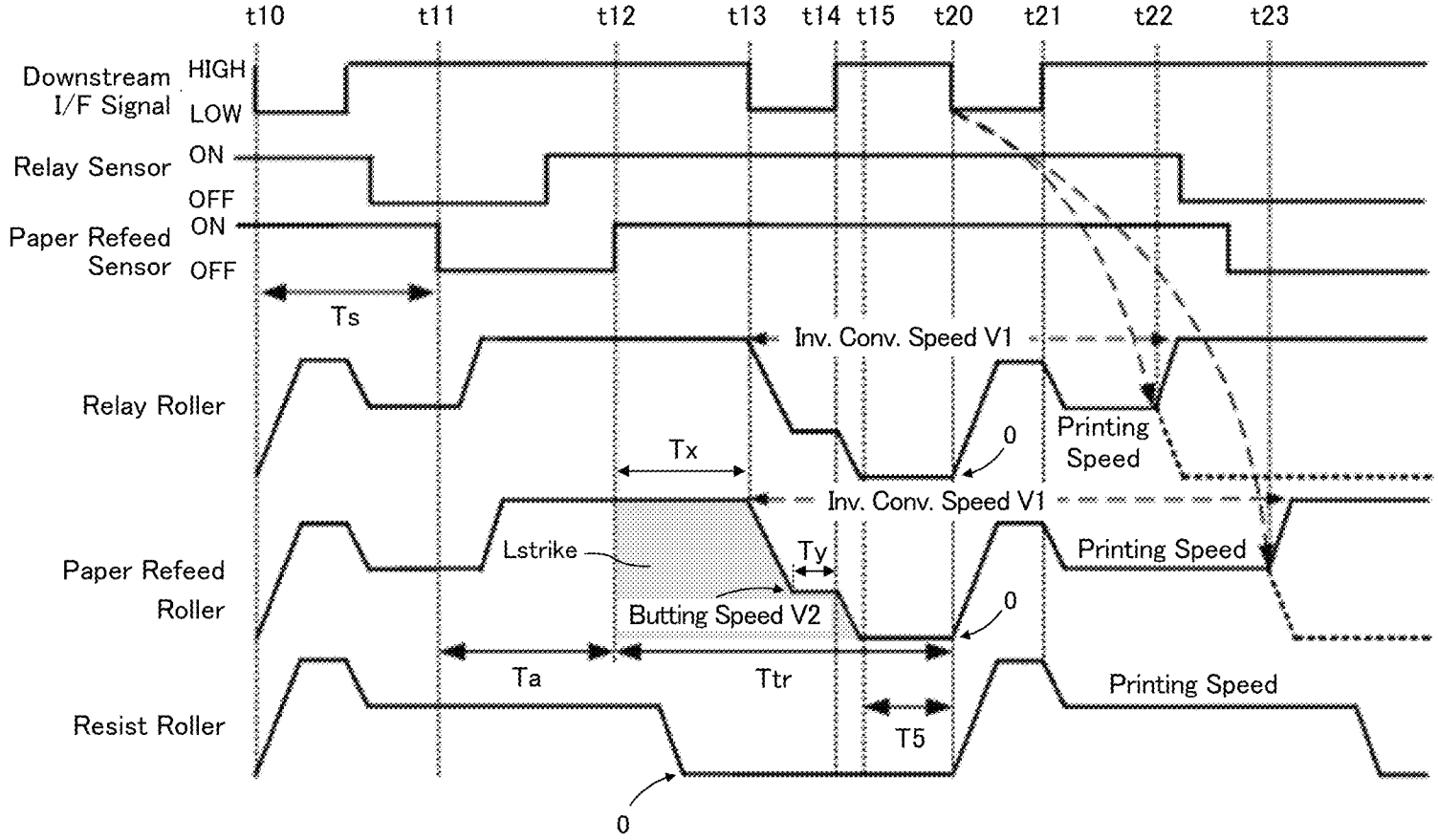
FIG. 3 is a time chart diagram showing the operation of a relay roller, a paper refeed roller, and a resist roller in one embodiment.

FIG. 3 is a time chart diagram showing the operation of the relay roller 48, the paper refeed roller 61, and the resist roller 64.

Figure 4:
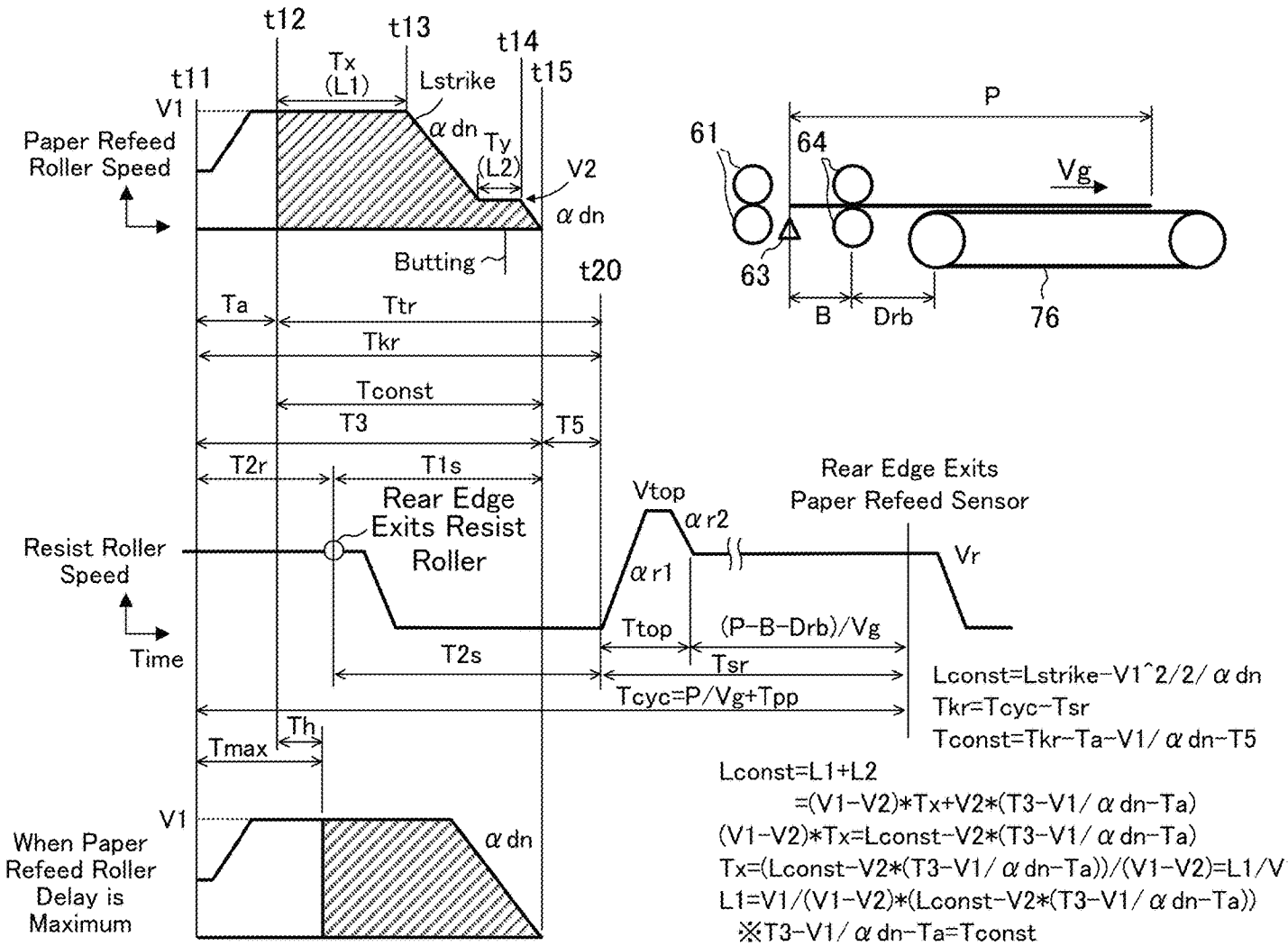
FIG. 4 illustrates a method for calculating the first period, second period, etc., in an embodiment.

FIG. 4 illustrates how to calculate the first period Tx, the second period Ty, etc.

Figure 5:
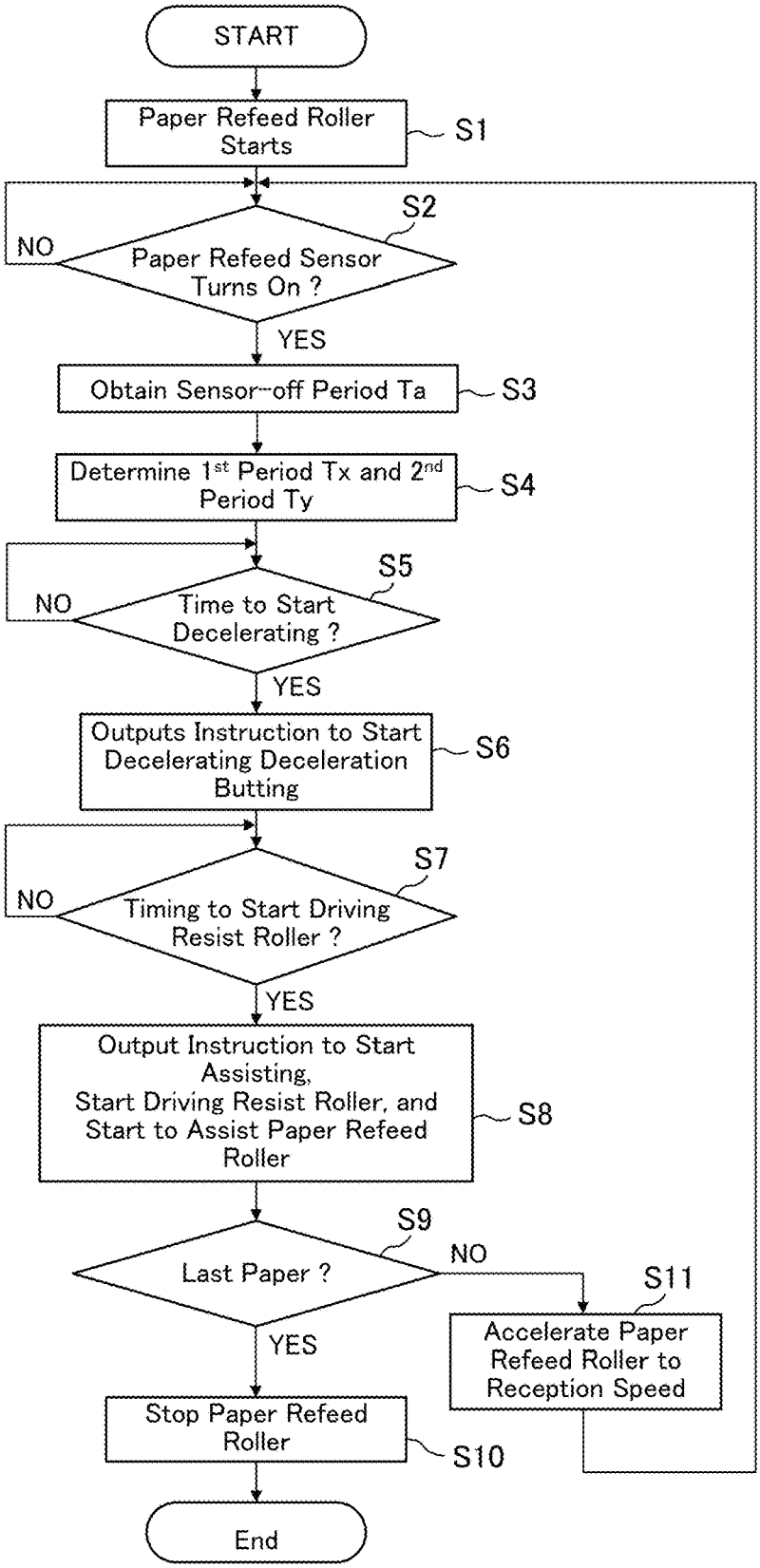
FIG. 5 is a flowchart showing the operation control of the paper refeed roller and the resist roller in one embodiment.

FIG. 5 is a flowchart showing the operation control of the paper refeed roller 61 and the resist roller 64.

First, when the intermediate device control unit 51 receives a LOW-level signal (downstream I/F signal) from the second printing device control unit 71, the intermediate device control unit 51 starts driving the relay roller 48, the paper refeed roller 61, and the resist roller 64 (time t10 in FIG. 3, step S1 in FIG. 5). This operation of the relay roller 48 and the paper refeed roller 61 is an assist operation that assists the conveyance of the paper P by the resist roller 64. The relay roller 48, the paper refeed roller 61, and the resist roller 64 accelerate to a predetermined speed and then decelerate to convey the paper P at the printing speed.

The relay sensor 50 detects the rear edge of the first sheet of paper P, and then the paper refeed sensor 63 detects the rear edge of the first sheet of paper P (at time t11 after time Ts). The time Ts can be calculated as a theoretical value (fixed value) for each printing condition.

When the paper refeed sensor 63 detects the leading edge of the second sheet of paper P (time t12, step S2: YES), the second printing device control unit 71 acquires the sensor off period Ta since the paper refeed sensor 63 detected the rear edge of paper P of the first sheet (step S3).

Also, the second printing device control unit 71 determines, based on the sensor off period Ta, a first period Tx in which the inverted conveyance speed V1 (an example of the first conveyance speed) of the paper refeed roller 61 at the detection time (time t12) of the leading edge of the second sheet of paper P detected by the paper refeed sensor 63 is maintained after this detection time. At the same time, the second printing device control unit 71 determines a second period Ty in which the butting speed V2 (an example of the second conveyance speed), which is the conveyance speed when the second sheet of paper P butts the resist roller 64, slower than the inverted conveyance speed V1, is maintained (step S4).

FIG. 4 illustrates how to calculate the first period Tx, the second period Ty, etc.

As shown in FIG. 4, the feed amount (conveyance amount) of the first period Tx in which the paper refeed roller 61 maintains the inverted conveyance speed V1 from the time when the leading edge of the paper P is detected by the paper refeed sensor 63 (time t12) to time t13 is L1 and the feed amount (conveyance amount) of the second period Ty in which the paper refeed roller 61 maintains the butting speed V2 from time t13 to time t14 is L2 after the inverted conveyance speed V1 is decelerated. The sum of these feed amounts L1 and L2 is Lconst, and the deceleration acceleration of the paper refeed roller 61 is αdn.

The feed amount Lstrike (shaded portion) from time t12 to time t15 is constant, for example, to keep the slack amount formed in the paper P constant. If the feed amount Lstrike of the paper refeed roller 61 is constant, the slippery paper P tends to have less slack than the non-slippery paper P. Therefore, the slower the actual conveyance time from the predetermined position of the paper P to the time t12 is (the more likely to slip), the more the feed amount Lstrike may be increased.

Lconst can be expressed as Lstrike−V1^2/2/αdn.

The time Tkr from the time t11 at which the rear edge of the preceding (first) sheet of paper P is detected by the paper refeed sensor 63 to the time when the drive of the resist roller 64 starts can be expressed as the difference between the time Tcyc from the time t11 to the time when the rear edge of the subsequent (second) sheet of paper P is detected by the paper refeed sensor 63 and the time Tsr from the time t20 to the time when the rear edge of the subsequent (second) sheet of paper P is detected by the paper refeed sensor 63. If the time obtained by subtracting the sensor off period Ta from the time Tkr is called the time Ttr, the drive cycle of the resist roller 64 can be expressed as the sum of the time Tsr, the sensor off period Ta, and the time Ttr.

The time Tconst, which is the sum of the first period Tx and the second period Ty, can be expressed as the value obtained by subtracting V1/αdn and the sensor off period Ta from the time T3 from time t11 to time t15, and can also be expressed as Tkr−Ta−V1/αdn−T5.

With each of the values described above, the feed amount L1 can be calculated as represented in the lower right column of FIG. 4. Therefore, the feed amount L2 can be calculated in the same way. If the feed amounts L1 and L2 can be calculated, the first period Tx and the second period Ty can be calculated by dividing the feed amounts L1 and L2 by the conveyance speed V1 and V2.

The above time Tcyc can be expressed as P/Vg+Tpp, wherein the length of the paper P in the conveying direction is P, the conveyance speed (printing speed) of the belt platen section 76 is Vg, and the time between papers is Tpp. If the distance from the paper refeed sensor 63 to the resist roller 64 is B and the distance from the resist roller 64 to the belt platen section 76 is Drb, the time Tsr can be expressed as the sum of the acceleration time of the acceleration αr1 of the resist roller 64, the conveyance time at the maximum speed Vtop, and the deceleration time Ttop of the deceleration αr2, and (P−B−Drb)/Vg. For calculating the above-described first period Tx and second period Ty, the time T2r from the time t11 until the rear edge of the preceding paper P exits the resist roller 64, the time T1s from the time the rear edge of the preceding paper P exits the resist roller 64 until the time t15, the time T2s from the time the rear edge of the preceding paper P exits the resist roller 64 until the time t20, and the like may be used as appropriate.

Here, for the slippery paper P, the time t12 at which the leading edge of the paper is detected by the paper refeed sensor 63 becomes later. Thus, the later the time t12 is, the longer the first period Tx becomes and the shorter the second period Ty becomes. However, when the sensor off period Ta becomes Tmax and time t12 is late by time Th, the second period Ty becomes zero. Therefore, when the sensor off period Ta exceeds Tmax, controlling the paper refeed roller 61 by adjusting the first period Tx and the second period Ty becomes impossible. In this case, it will not be possible to secure the subsequent time T5. Therefore, if the synchronization control of the resist roller 64, the paper refeed roller 61, and the like, cannot be performed stably due to the inability to secure time T5 or the like, it is recommended that the drive start time (time t20) of the resist roller 64 be delayed. After that, when the paper P has reached the paper refeed sensor 63 or the like, the control returns to the control as shown in FIG. 3.

The above-described calculation is performed, for example, by the second printing device control unit 71. It can be said that the second printing device control unit 71 controls the paper refeed roller 61 via the intermediate device control unit 51 so that the slack amount of the subsequent sheet of paper P becomes constant by calculating the first period Tx and the second period Ty based on the time t11, which is the detection time of the rear edge of the preceding (first) paper P detected by the paper refeed sensor 63 (passage detection sensor) and the time t12, which is the detection time of the leading edge of the subsequent (second) paper P detected by the paper refeed sensor 63. Instead of the time t11, the time when the rear edge of the preceding paper P is detected by the relay sensor 50, the time when the drive of each roller of the preceding paper P starts, and the like may be used. Therefore, time t11 can be said to be an example of the conveyance status of the preceding paper P. However, it is desirable to use the time t11 closest to the time t12 at which the leading edge of the subsequent paper P is detected by the paper refeed sensor 63.

In this embodiment, the first period Tx and the second period Ty are calculated based on the detection time, etc., of the paper refeed sensor 63, an example of the passage detection sensor. The first period Tx and the second period Ty may be calculated based on this sensor's detection time, etc., with another sensor disposed upstream of the resist roller 64 as another example of the passage detection sensor. The deceleration αdn of the paper refeed roller 61 may be adjusted instead of at least one of the first period Tx and the second period Ty. In this embodiment, control of the paper refeed roller 61, an example of a conveyor roller, is described. However, the paper refeed roller 61 and other conveyor rollers such as, for example, the relay roller 48 may be used as the conveyor roller to be controlled. The calculation of the first period Tx and the second period Ty and the control of the paper refeed roller 61 may be performed by another control unit such as the intermediate device control unit 51.

Based on the first period Tx calculated as described above, the second printing device control unit 71 repeats the judgment until the deceleration start timing (time t13) after the first period Tx has elapsed from the time when the paper refeed sensor 63 detects the second sheet of paper P (step S5).

When the deceleration start timing is reached (step S5: YES), the second printing device control unit 71 switches the signal to the intermediate device control unit 51 to a LOW-level signal (time t13). As a result, when the intermediate device control unit 51 starts decelerating the relay roller 48 and the paper refeed roller 61 to the butting speed V2, the butting speed V2 is maintained for a second period Ty until the HIGH-level signal (time t14) of the second printing device control unit 71 is received. Then, in the middle of the second period Ty, the leading edge of the second sheet of paper P butts the resist roller 64 in the suspended state, forming a slack in the paper P and correcting the skew (step S6).

After that, the relay roller 48 and the paper refeed roller 61 stop at the end time of the slack formation (time t15), and after a lapse of time T5 therefrom, the second printing device control unit 71 transmits a LOW-level signal. When the intermediate device control unit 51 receives this LOW-level signal (step S7: YES), the intermediate device control unit 51 starts driving the resist roller 64 and also starts driving the relay roller 48, and the paper refeed roller 61 for the assist operation (time t20, step S8).

When the intermediate device control unit 51 receives the HIGH-level signal of the second printing device control unit 71 (time t21), the speed of the relay roller 48, the paper refeed roller 61, and the resist roller 64 is temporarily decelerated from the predetermined speed after acceleration to the printing speed.

After that, the intermediate device control unit 51 judges whether or not the second sheet of paper P is the last sheet of paper P in the print job being executed (step S9). If the conveyed sheet of paper P is the second and last sheet of paper P (step S9: YES), the intermediate device control unit 51 stops the relay roller 48 and the paper refeed roller 61 after the predetermined time from the above-described LOW-level signal (time t20) of the second printing device control unit 71, respectively, as shown by the dotted line in FIG. 3, and the process shown in FIG. 5 is completed.

On the other hand, if the paper P to be conveyed is the second and not the last (step S9: NO), the intermediate device control unit 51 accelerates the relay roller 48 and the paper refeed roller 61 to the inverted conveyance speed V1 (reception speed) after a predetermined time elapses from the above-described LOW-level signal (time t20) of the second printing device control unit 71, respectively (step S11), and returns to the process of step S2 described above.

Here, the above-described predetermined time is, for the relay roller 48, the timing (time t22) at which the rear edge of the subsequent paper P exits the relay roller 48 just before the rear edge of the subsequent paper P exits the relay sensor 50, which can be determined with reference to the drive start time of the resist roller 64 (time t20), and, for the paper refeed roller 61, the timing (time t23) after the rear edge of the subsequent paper P exits the paper refeed sensor 63.

A situation may occur in which the printing process of the first printing device 2 is delayed and the above-described sensor off period Ta becomes too long so that the second period Ty of the butting speed V2 becomes zero and the paper P butts the resist roller 64 at a conveyance speed faster than the butting speed V2. For this reason, it is recommended that the paper refeed roller 61 be controlled so that the conveyance speed when the above-referenced subsequent (second) sheet of paper P butts the resist roller 64 is less than the predetermined speed (e.g., the butting speed V2) when the sensor off period Ta is more than the predetermined time. For example, if the sensor off period Ta is a predetermined time or longer, the first period Tx and the second period Ty may be set to predetermined values to secure the time T5 and to delay the drive start time (time t20) of the resist roller 64.

The paper P conveyed to the printing unit 66 is printed on the backside by the head unit 77 and conveyed by the belt platen section 76. The paper P printed in the printing unit 66 is discharged by the paper discharge rollers 67 and 68 to the paper discharge table 70.

In the description of the operation of duplex printing described above, the case where the size of the paper P is the predetermined size or larger is described, but when the size of the paper P is less than the predetermined size, the deceleration butting operation and the assisting operation of the relay roller 48 synchronized with the paper refeed roller 61 are not performed. Specifically, suppose the paper P is of a size out of the relay rollers 48 (not nipped by the relay rollers 48) when the paper P butts the resist rollers 64. In that case, the relay rollers 48 continue to be driven at the inverted conveyance speed V1. That is, the intermediate device control unit 51 controls the relay roller 48 to perform a deceleration butting operation and an assisting operation synchronized with the paper refeed roller 61 according to the paper size.

When single-sided printing is performed with the printing system 1, printing is performed on the surface of the paper P in the first printing device 2 by the same operation as during the duplex printing described above. The printed paper P is conveyed to the second printing device 4 via the inversion path RR of the intermediate device 3. In the second printing device 4, the paper P is conveyed along the downstream conveyance path RD without being printed and is discharged to the paper discharge table 70. The printing may be performed on the second printing device 4 without printing on the first printing device 2. The paper P discharged from the first printing device 2 may be conveyed to the second printing device 4 without being turned face down by passing through the non-inverted intermediate path RC of the intermediate device 3.

In the present embodiment described above, the printing system 1 has a printing unit 16 (an example of a first printing part) that prints on a paper P (an example of a medium), a printing unit 66 (an example of a second printing part) that is disposed downstream in a conveying direction of the paper P from the printing unit 16 and prints on the paper P, and a conveyance mechanism that conveys the paper P printed by the printing unit 16 to the printing unit 66. The conveyance mechanism has a paper refeed sensor 63 (an example of a passage detection sensor) that detects the passage of the paper P, a paper refeed roller 61 (an example of a conveyor roller) that conveys the paper P, and a resist roller 64 that is disposed downstream in the conveying direction from the paper refeed sensor 63, and the paper refeed roller 61, which the paper P butts. The resist roller conveys the paper P, which has slackened due to the butting. The printing system 1 is also provided with a second printing device control unit 71 (an example of a controller) that controls the paper refeed roller 61 so that the slack amount of the subsequent paper P becomes constant based on the conveyance status of the preceding paper P and the detection time (time t12) of the leading edge of the subsequent paper P detected by the paper refeed sensor 63.

As a result, even if the detection time (time t12) at which the leading edge of the paper P is detected by the paper refeed sensor 63 is delayed due to slippage of the paper P caused by a high printing rate of the paper P, or the like, the slack amount of the paper P formed by butting the resist roller 64 can be kept constant. In addition, the conveyance end time of the paper refeed motor 62 (time t15), and thus the conveyance start time of the paper P by the resist roller 64 (time t20), can be kept constant. Therefore, when the conveyance of the preceding paper P is delayed, and the conveyance of the subsequent paper P is not delayed, a delay in the drive end time of the resist roller 64 for conveying the preceding paper P can be avoided. This avoids a subsequent medium M reaching the resist roller 64 before the drive end of the resist roller 64 and the leading edge of the subsequent medium M exiting the resist roller 64 so that no slack is formed in the subsequent medium M. As described above, forming a certain amount of slack in the paper P can suppress the occurrence of skewing of the paper P. Therefore, according to the present embodiment, even if a conveyance delay occurs in the paper P printed by the upstream printing unit 16, a skew defect in the downstream printing unit 66 can be suppressed. It is also possible to maintain the productivity of the paper P by setting the conveyance start time (time t20) of the paper P by the resist roller 64 to a constant interval.

In the present embodiment, the conveyance status of the preceding paper P above is the detection time (time t11) of the rear edge of the preceding paper P detected by the paper refeed sensor 63.

Therefore, at time t11, which is close to the detection time (time t12) at which the leading edge of the subsequent paper P is detected by the paper refeed sensor 63, the conveyance status of the preceding paper P can be accurately determined. As a result, the occurrence of a skew defect can be more reliably suppressed, and the leading edge of the subsequent medium M can be more reliably prevented from passing through the resist roller 64 and forming no slack in the subsequent medium M.

In the present embodiment, the second printing device control unit 71 controls the paper refeed roller 61 so that when the difference (sensor off period Ta) between the detection time (time t11) of the rear edge of the preceding paper P detected by the paper refeed sensor 63 and the detection time (time t12) of the leading edge of the subsequent paper P detected by the paper refeed sensor 63 is a predetermined time or more, the conveyance speed when the subsequent paper P butts the resist roller 64 is less than the predetermined speed.

By the way, when the first printing device 2 is connected upstream of the conveyance mechanism, the interval of the paper P reaching the second printing device 4 may widen beyond a predetermined value according to the conveyance status (empty feed, etc.) of the first printing device 2. However, in such a case, it is disadvantageous for the productivity of the paper P to judge it as a jam and stop the printing system 1. In such a case, if the speed of the subsequent paper P butting the resist roller 64 is made faster to keep the conveyance start time (time t20) by the resist roller 64 of the subsequent paper P close to a constant, the collision noise becomes louder, and the damage to the paper P increases. As a result, even if the conveyance start time (time t20) of the resist roller 64 is delayed and the conveyance interval of the paper P to the second printing device 4 is wider than usual, the appropriate skew correction by securing the amount of deflection in the resist roller 64 and the reduction of the collision noise can be achieved without much reduction in the productivity of the paper P.

In the present embodiment, the second printing device control unit 71 controls the paper refeed roller 61 by adjusting the first period Tx. This first period Tx is a period during which the inverted conveyance speed V1 (an example of the first conveyance speed) of the paper refeed roller 61 is maintained from the detection time (time t12) of the leading edge of the subsequent paper P detected by the paper refeed sensor 63.

Therefore, with the simple control of adjusting a period of the inverted conveyance speed V1, which is, for example, the maximum speed of the paper refeed roller 61, and with a simple configuration that does not use the paper refeed motor 62 that enables a conveyance speed faster than the inverted conveyance speed V1, the conveyance start time (time t20) of the paper P by the resist roller 64 can be made constant.

In the present embodiment, the second printing device control unit 71 controls the paper refeed roller 61 so that the conveyance speed of the paper refeed roller 61 becomes a butting speed V2 (an example of the second conveyance speed) slower than the reverse conveyance speed V1 when the subsequent paper P butts the resist roller 64. The second printing device control unit 71 controls the paper refeed roller 61 by adjusting the first period Tx and the second period Ty in which the paper refeed roller 61 maintains the butting speed V2.

Therefore, by simple control of adjusting a period between an inverted conveyance speed V1, which is, for example, the maximum speed of the paper refeed roller 61, and a butting speed V2, which is slower than this inverted conveyance speed V1 and thus can reduce the collision noise, the conveyance start time (time t20) of the paper P by the resist roller 64 can be made constant. It is possible to reduce the collision noise of the butting of the paper P that occurs when forming the slack.

The present invention is not limited to the above-described embodiments as they are but may be embodied by transforming the components to the extent that the summary thereof does not depart at the implementation stage. Also, various inventions can be formed by appropriate combinations of the plurality of components disclosed in the above-described embodiments. For example, all of the components shown in the embodiments may be combined as appropriate. It is, of course, possible to make various transformations and applications within the scope of the invention without departing from the gist of the invention. The invention described in the scope of claims of the original Japanese application of the present application is appended below.

In one aspect, the present application relates to a printing system that comprises a first printing part that prints on the medium, a second printing part that is disposed downstream of the first printing part in the conveying direction of the medium and prints on the medium, and a conveyance mechanism that conveys the medium printed by the first printing part to the second printing part. The conveyance mechanism comprises a passage detection sensor that detects the passage of the medium, a conveyor roller for conveying the medium, and a resist roller that is disposed downstream in the conveying direction from the passage detection sensor and the conveyor roller, that is butted by the medium, and that conveys the medium slackened due to the butting. The printing system further comprises a controller configured to control the conveyor roller so that the slack amount of the subsequent medium is constant based on the conveyance status of the preceding medium and the detection time of the leading edge of the subsequent medium detected by the passage detection sensor.

In one other aspect, the conveyance status of the preceding medium is the detection time of the rear edge of the preceding medium detected by the passage detection sensor.

In one other aspect, the control unit controls the conveyor roller so that when the difference between the detection time of the rear edge of the preceding medium detected by the passage detection sensor and the detection time of the leading edge of the subsequent medium detected by the passage detection sensor is more than a predetermined time, the conveyance speed is less than the predetermined speed when the subsequent medium butts the resist roller.

In one other aspect, the control unit controls the conveyor roller by adjusting a first period during which the first conveyance speed of the conveyor roller is maintained from the detection time of the leading edge of the subsequent medium.

In another aspect, the control unit controls the conveyor roller such that the conveyance speed of the conveyor rollers is a second conveyance speed slower than the first conveyance speed when the subsequent medium butts the resist roller. The control unit controls the conveyor roller by adjusting the first period and the second period in which the conveyor roller maintains the second conveyance speed.

What is claimed is:

1. A printing system, comprising:

a first printing part that prints on a medium;

a second printing part that is disposed downstream of the first printing part in a conveying direction of the medium and prints on the medium; and a conveyance mechanism that conveys the medium printed on by the first printing part to the second printing part, wherein the conveyance mechanism comprises:

a passage detection sensor that detects the leading edge and the rear edge of the medium;

a conveyor roller for conveying the medium; and a resist roller that is disposed downstream in the conveying direction from the passage detection sensor and the conveyor roller, that is butted by the medium, and that conveys the medium slackened due to the butting, and the printing system further comprises a controller configured to control the conveyor roller so that a slack amount of a subsequent medium is constant based on a difference between a detection time of the rear edge of a preceding medium detected by the passage detection sensor and a detection time of the leading edge of the subsequent medium detected by the passage detection sensor, wherein the controller controls the conveyor roller by adjusting a first period in which a first conveyance speed of the conveyor roller is maintained from the detection time of the leading edge of the subsequent medium.

2. The printing system according to claim 1, wherein the controller controls the conveyor roller so that the conveyance speed when the subsequent medium butts the resist roller is less than a predetermined speed when the difference between the detection time of the rear edge of the preceding medium detected by the passage detection sensor and the detection time of the leading edge of the subsequent medium detected by the passage detection sensor is more than a predetermined time.

3. The printing system according to claim 1, wherein the controller controls the conveyor roller so that the conveyance speed of the conveyor roller is a second conveyance speed slower than the first conveyance speed when the subsequent medium butts the resist roller, and the controller controls the conveyor roller by adjusting the first period and a second period in which the conveyor roller maintains the second conveyance speed.

* * * * *